US006979400B2

(12) United States Patent
Bauckman et al.

(10) Patent No.: US 6,979,400 B2
(45) Date of Patent: Dec. 27, 2005

(54) AUTOMATIC SWIMMING POOL CLEANERS WITH SHAPED FLOATS AND WATER-TEMPERATURE OR -PRESSURE INDICATORS AND WATER-CIRCULATION SYSTEMS INCORPORATING SUCH INDICATORS

(75) Inventors: Mark J. Bauckman, Boca Raton, FL (US); Robin Ellis, Fort Lauderdale, FL (US); Hendrikus Johannes van der Meijden, Midrand (ZA); Peter Hugh Harrison, Centurion (ZA); Michael Edward Moore, Johannesburg (ZA); Alexis Wadman, Barneveld (NL)

(73) Assignee: Zodiac Pool Care, Inc., Pompano Beach, FL (US)

( * ) Notice: Subject to any disclaimer, the term of this patent is extended or adjusted under 35 U.S.C. 154(b) by 39 days.

(21) Appl. No.: 10/616,777

(22) Filed: Jul. 10, 2003

(65) Prior Publication Data

US 2005/0006288 A1 Jan. 13, 2005

(51) Int. Cl.[7] ..... E04H 4/16; G01K 11/12

(52) U.S. Cl. ..... 210/169; 210/94; 210/242.1; 210/416.2; 15/1.7

(58) Field of Search ..... 210/94, 169, 242.1, 210/416.1, 416.2; 15/1.7; 374/156

(56) References Cited

U.S. PATENT DOCUMENTS 3,665,942 A * 5/1972 Moore ..... 134/167 R
3,767,055 A * 10/1973 Flatland ..... 210/242.1
4,009,675 A * 3/1977 Zollner et al. ..... 114/267
4,351,077 A 9/1982 Hofmann
4,431,538 A * 2/1984 Selsted ..... 210/169
4,652,366 A * 3/1987 Brooks ..... 210/169
4,802,592 A * 2/1989 Wessels ..... 210/169
5,014,382 A 5/1991 Kallenbach
5,143,605 A * 9/1992 Masciarelli ..... 210/169
5,169,236 A * 12/1992 Iest ..... 374/156
5,554,277 A * 9/1996 Rief et al. ..... 210/94
5,681,110 A * 10/1997 Burzacchi ..... 374/156
5,882,512 A 3/1999 Denkewicz, Jr. et al.
5,961,822 A * 10/1999 Polimeni, Jr. ..... 210/94
5,996,906 A * 12/1999 Cooper ..... 239/229
6,200,487 B1 * 3/2001 Denkewicz et al. ..... 210/749
6,238,553 B1 * 5/2001 Lin ..... 210/94
6,365,039 B1 * 4/2002 Henkin et al. ..... 210/103

* cited by examiner

*Primary Examiner*—Fred G. Prince
(74) *Attorney, Agent, or Firm*—Dean W. Russell; Kilpatrck Stockton LLP

(57) ABSTRACT

Mobile apparatus, typically in the form of automatic swimming pool cleaners, capable of indicating temperatures (or pressures) of the pool water in which they are deployed are discussed. The indication may, but need not necessarily, occur through change in color of one of more components of the cleaners. Some versions may have floats adapted to provide this color change. These or other versions may include floats that are not spherical in shape as well. Alternatively, temperature (or pressure) indication may be provided by other aspects of a water-circulation system.

28 Claims, 3 Drawing Sheets

AUTOMATIC SWIMMING POOL CLEANERS WITH SHAPED FLOATS AND WATER-TEMPERATURE OR -PRESSURE INDICATORS AND WATER-CIRCULATION SYSTEMS INCORPORATING SUCH INDICATORS

FIELD OF THE INVENTION

This invention relates to apparatus for cleaning vessels such as swimming pools and more particularly to automatic swimming pool cleaners with either or both of innovative floats and water-temperature or -pressure indicators. It also relates to water-circulation systems incorporating such indicators.

BACKGROUND OF THE INVENTION

U.S. Pat. No. 4,351,077 to Hofmann, incorporated herein in its entirety by this reference, discloses an exemplary automatic swimming pool cleaner. Included as part of the cleaner is a body (called a "head") incorporating a buoyancy chamber. As described in the Hofmann patent, the buoyancy chamber preferably is provided with a hollow float. This chamber ensures that while the head will sink with the aid of any necessary weights onto the surface to be cleaned it will, nevertheless, be correctly orientated thereto.

See Hofmann, col. 3, 11. 55–58 (numeral omitted). Such hollow float is not depicted in the Hofmann patent, however, nor is it otherwise detailed.

U.S. Pat. No. 5,014,352 to Kallenbach, also incorporated herein in its entirety by reference, discusses automatic swimming pool cleaners likewise including a main body through which a fluid-flow passage extends. According to the Kallenbach patent, "normally used floats . . . have been removed and replaced" in favor of a hollow hemispherical part "[p]rojecting rearwardly from the upper part of the body." See Kallenbach, col. 2, 11. 59–60; col. 3, 11. 19–22. In commercial embodiments of the cleaners of the Kallenbach patent, the hemispherical part is opaque and the float thus not visible.

U.S. Pat. No. 5,882,512 to Denkewicz, Jr., et al., similarly incorporated herein in its entirety by reference, details additional automatic swimming pool cleaners which may filter water both mechanically and chemically. By contrast with the "suction-side" cleaners of the Hofmann and Kallenbach patent-which attach to the inlet side of a swimming pool water-circulating pump—various illustrated cleaners of the Denkewicz, Jr. patent connect to the outlet side of the pump. Such cleaners often are referred to as "pressure-side" cleaners and sometimes lack any sort of dedicated float.

None of these patents explicitly identifies the shape of any buoyancy-enhancing float for an automatic swimming pool cleaner. None, further, describes a float visible to persons purchasing and using automatic swimming pool cleaners. Although the innovative cleaners of the Denkewicz, Jr. patent perform functions beyond mechanically filtering water, neither they nor other conventional swimming pool cleaners provide any indication of the temperature of the water or other fluid in which the cleaners operate. Having water-temperature indicating ability in a cleaner frequently may be useful, both in determining whether the water in the vessel is suitable for swimming and, potentially, in ascertaining whether the cleaner is likely to operate acceptably (or optimally).

SUMMARY OF THE INVENTION

The present invention provides automatic swimming pool cleaners or other mobile apparatus capable of indicating temperatures of the fluid in which they are placed for operation. Such indication may, but need not necessarily, occur through changes in color of one or more components of the cleaners. If the indication indeed is supplied through component color changes, at least one of the colors utilized preferably (but again not necessarily) is visible from outside the vessels in which the cleaners may be placed.

Some embodiments of the present cleaners provide buoyancy-enhancing floats imbued with this water-temperature indicating ability. These floats preferably remain wholly or partly incorporated into the main bodies of the cleaners with which they are associated. Unlike floats of existing commercial cleaners, however, those of these embodiments are visible to users of the cleaners. Consequently, their colors may easily be viewed by prospective users of the pools without necessarily removing the cleaners from the pools.

To permit this visibility, portions of the bodies of the cleaners may be formed of clear (non-opaque) materials. Some embodiments of the cleaners include a clear plastic window into a buoyancy chamber of the body through which the float may be seen. Alternatively, the body itself may be transparent or translucent, or a non-opaque chamber separate from the body may be employed.

Various versions of cleaners consistent with the present invention may, as well, utilize floats shaped differently than existing commercial cleaner floats. These floats thus need not be spherical or cylindrical, as are at least some conventional floats. Instead, preferred floats may have oval or elliptical cross-section (or substantially so) and resemble eggs in three dimensions.

Alternative embodiments of the invention position water-temperature indicating means elsewhere in water-circulation systems of swimming pools. Such systems typically include hoses, pumps, pipes, valves, and fittings through which pool water passes. Any of these or other portions of the systems could incorporate the indicating means, although preferably the means is located at least partially within the perimeters of the pools. Yet other versions include means for discerning information about pressures of water flowing to pressure-side cleaners.

It thus is an optional, non-exclusive object of the present invention to provide mobile apparatus capable of indicating temperature of fluid in which they are deployed.

It also is an optional, non-exclusive object of the present invention to provide swimming pool cleaners or other parts of water-circulation systems with water-temperature or -pressure indicating ability.

It is another optional, non-exclusive object of the present invention to provide pool cleaners having one or more components adapted to change color as a function of the temperature of water in which they operate.

It is a further optional, non-exclusive object of the present invention to provide pool cleaners containing floats with such color-changing characteristics.

It is, moreover, an optional, non-exclusive object of the present invention to provide swimming pool cleaners having bodies in which the floats are placed, with the bodies adapted to permit the floats to be viewed externally.

It is yet another optional, non-exclusive object of the present invention to provide pool cleaners with buoyancy-enhancing floats that are not spherical in shape.

It is an additional optional, non-exclusive object of the present invention to provide pool cleaners whose floats are generally egg-shaped.

Other objects, features, and advantages of the present invention will be apparent to those skilled in the appropriate field with reference to the remaining text and drawings of this application.

DETAILED DESCRIPTION

Figure 1:
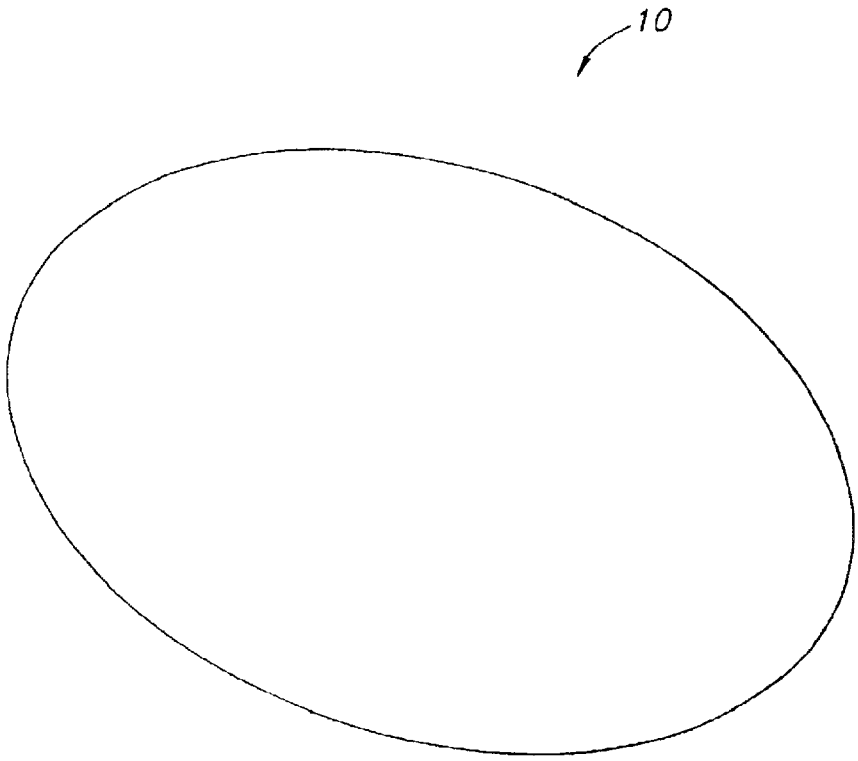
FIG. 1 depicts an exemplary float of the present invention adapted for use with an automatic swimming pool cleaner.

FIG. 1 shows a version of float 10 of the present invention. As illustrated, float 10 has the general shape of an egg. As a consequence, float 10 may have an oval or elliptical cross-section. If appropriate or desired, float 10 additionally may include one or more recesses or projections to facilitate its placement or retention in automatic swimming pool cleaner 14 (see FIG. 2).

Preferred embodiments of float 10 are buoyant in water. Float 10 thus may be used to provide buoyancy to cleaner 14 depicted in FIG. 2. Together with weights conventionally used in such cleaners, float 10 may assist in balancing cleaner 14 as it moves within a pool or other vessel. Choosing an egg-shaped design for float 10 may, in some situations, enhance or optimize the righting moment of cleaner 14. Those skilled in the art will, however, recognize that float 10 may be shaped other than generally as an egg and yet function acceptably in many versions of cleaner 14 (including those not resembling the version illustrated in FIG. 2).

Float 10 additionally may have one or more characteristics that change as a function of the temperature of the water within the pool within which cleaner 14 operates. In some embodiments of the invention (although not necessarily), float 10 is adapted to change color depending on ambient water temperature. As a non-limiting example of such adaptation, float 10 may be blue when the water temperature is less than approximately seventy degrees Fahrenheit (70° F.), bluish-green when the water temperature is approximately 70–80° F., and green when the temperature approximates 80° F. or more. Changes to other colors, or at other temperatures or ranges, may occur instead, however. Further, more than one such color change of float 10 may occur as a function of water temperature if appropriate or desired.

A purpose of such color change may be to assist a pool owner, manager, or user in determining the suitability of the pool water for purposes of swimming, bathing, or other activities. Hence, having float 10 change color one or more times between, for example, 70–90° F. could be useful. Alternatively or additionally, float 10 could provide information concerning potential effectiveness of cleaner 14 in cleaning debris contained within a pool. Although the optimal temperature range for cleaning effectiveness may differ from cleaner to cleaner and is typically quite broad, some automatic pool cleaners may be able to clean better, or at lower water flow rates through the pump, when the ambient temperature of the water in which they operate is relatively warm. Hence, having float 10 change color below approximately 70° F., for example, may provide information as to its cleaning effectiveness at a particular time in a particular pool useful in determining whether then to operate cleaner 14.

Figure 2:
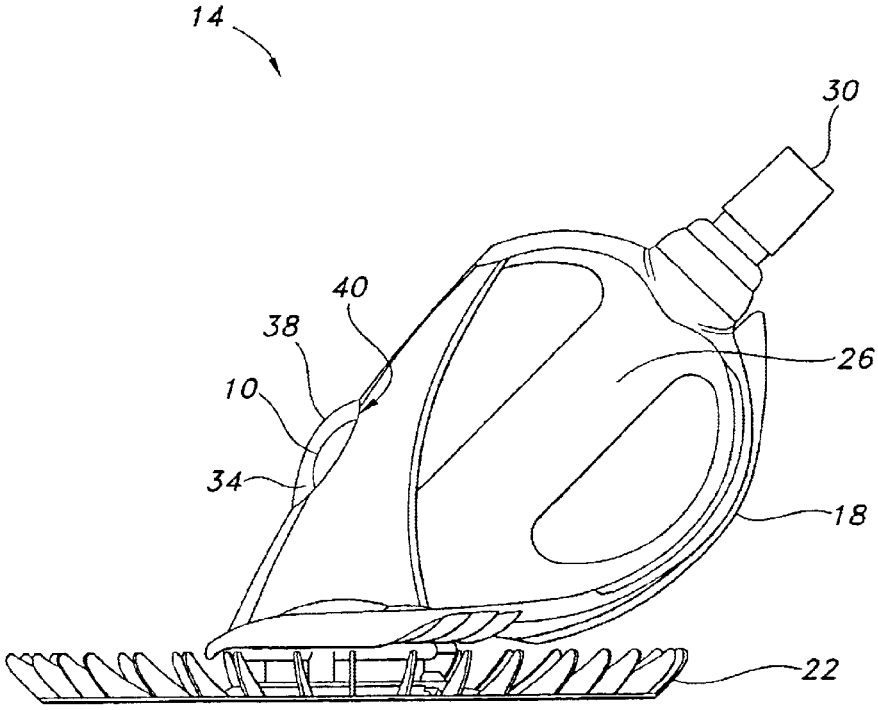
FIG. 2 illustrates an exemplary automatic swimming pool cleaner in which the float of FIG. 1 is employed.

Depicted in FIG. 2 is a sample automatic pool cleaner 14 containing float 10. Cleaner 14 defines body 18 and may be connected to or integrally formed with pad or disc 22. Although not shown in FIG. 2, body 18 may include a water inlet circumscribed by disc 22, as well as fluid-flow passage 26 terminating in outlet 30. When cleaner 14 is operating, outlet 30 typically connects to a hose or pipe under control of a pump associated with a water-circulation system for the pool in which cleaner 14 resides.

As illustrated in FIG. 2, body 18 incorporates buoyancy chamber 34 containing float 10. Chamber 34 may be defined in part by non-opaque material 38, preferably clear plastic, forming a window into the chamber 34. Float 10 thus may be viewed through material 38 to ascertain its color without having to remove it from body 18. Indeed, float 10 advantageously is visible through material 38 without removing cleaner 14 from the pool in which it may be placed.

Alternatively, material 38 (and buoyancy chamber 34) may be omitted. In certain preferred embodiments lacking material 38, float 10 is fitted into opening 40 of body 18 so that it is attached at and retained in the opening 40 (mid-way along the trailing edge of cleaner 14) but protrudes therefrom (as also shown in FIG. 2). In these embodiments, float 10 is partially contained within body 18 yet extends outside the body 18 too. If desired, further, any or all of body 18 may be made transparent or translucent so that float 10 may be visible regardless of whether it is partly or wholly contained within the body 18.

Figure 3:
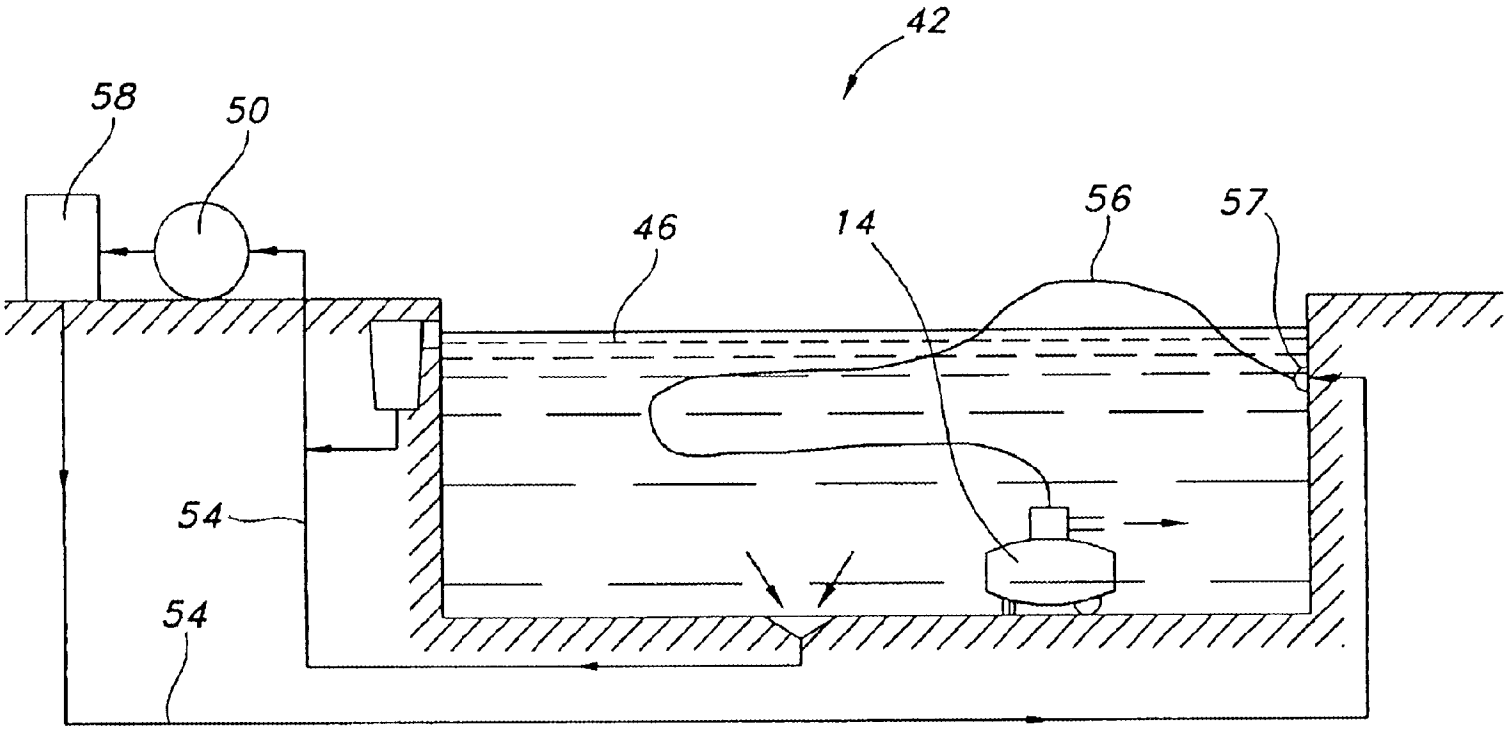
FIG. 3 is a block diagram of aspects of an exemplary water-circulation system containing water-temperature indicating means.

FIG. 3 shows, in a block diagram, components of an exemplary water-circulation system 42. System 42 may include swimming pool 46 wholly or partly filled with water, pump 50, and piping 54 connecting the two. If present, automatic pool cleaner 14 may connect to piping 54 as well via hoses 56 or other means. Valves, fittings 57, filter 58, and other items or objects optionally may form part of system 42 too. An indicator of information concerning the temperature (or pressure) of pool water flowing through system 42 may be included as desired anywhere within the system 42. As a non-limiting example of such an alternative placement, any of the hoses 56 used to connect cleaner 14 to piping 54 could be adapted to change color or some other characteristic as a function of water temperature or pressure. Those skilled in the art will recognize that, as depicted, system 42 is constructed for use with a pressure-side cleaner 14, although it may be modified as appropriate for use with a suction-side of other cleaner 14 instead.

The foregoing is provided for purposes of illustrating, explaining, and describing exemplary embodiments and certain benefits of the present invention. Modifications and adaptations to the illustrated and described embodiments will be apparent to those skilled in the relevant art and may be made without departing from the scope or spirit of the invention.

What is claimed is:

1. An automatic swimming pool cleaner for use in a swimming pool, comprising:

a. a body (i) automatically displaceable within the swimming pool and (ii) through which water contained in the swimming pool may flow; and b. a float at least partly contained within the body but visible therethrough.

2. An automatic swimming pool cleaner according to claim 1 in which the body comprises a window through which the float is visible.

3. An automatic swimming pool cleaner according to claim 1 in which the float protrudes outside the body.

4. An automatic swimming pool cleaner according to claim 1 in which the body is automatically displaceable laterally within the swimming pool.

5. An automatic swimming pool cleaner according to claim 4 further comprising means for attachment to a hose.

6. An automatic swimming pool cleaner according to claim 1 in which the float protrudes outside the body.

7. An automatic swimming pool cleaner according to claim 6 in which the float is attached at and retained in the opening.

8. An automatic swimming pool cleaner according to claim 1 in which the float is generally egg-shaped.

9. An automatic swimming pool cleaner according to claim 8 in which the float is generally egg-shaped.

10. An automatic swimming pool cleaner for use in a swimming pool, comprising:

a. a body (i) automatically displaceable within the swimming pool and (ii) through which water contained in the swimming pool may flow; and b. a float (i) having an oval or elliptical cross-section, (ii) contained within the body, and (iii) indicating information concerning the temperature of the water.

11. An automatic swimming pool cleaner according to claim 10, in which the body comprises a buoyancy chamber in which the float is contained.

12. An automatic swimming pool cleaner according to claim 10 in which the float is generally egg-shaped.

13. An automatic swimming pool cleaner for use in a swimming pool adapted to contain water whose temperature may vary as a function of time, comprising:

a. a body (i) automatically displaceable within the swimming pool and (ii) through which the water may flow; and b. means for indicating information concerning the temperature of the water.

14. An automatic swimming pool cleaner according to claim 13, in which the body is automatically displaceable laterally within the swimming pool and the temperature information indicating means is, at least in part, in, on, or attached to the body.

15. An automatic swimming pool cleaner according to claim 14 further comprising means for attachment to a hose.

16. An automatic swimming pool cleaner for use in a swimming pool adapted to contain water whose temperature may vary as a function of time comprising:

a. a body (i) automatically displaceable within the swimming pool and (ii) through which the water may flow; and b. means for indicating information concerning the temperature of the water, the temperature information-indicating means changing color to provide the water-temperature information.

17. An automatic swimming pool cleaner according to claim 16 in which the temperature information indicating means comprises a float.

18. An automatic swimming pool cleaner according to claim 17 in which the float is contained within the body.

19. An automatic swimming pool cleaner according to claim 18 in which the body comprises a bouyancy chamber in which the float is contained.

20. An automatic swimming pool cleaner according to claim 19 in which the body comprises a non-opague portion permitting viewing of the float externally of the body.

21. An automatic swimming pool cleaner according to claim 20 in which the float is non-spherical in shape.

22. An automatic swimming pool cleaner according to claim 21 in which the float is generally egg-shaped.

23. A swimming pool water-circulation system comprising:

a. a swimming pool containing water;

b. an automatic swimming pool cleaner placed in the swimming pool;

c. a pump in fluid communication with the automatic swimming pool cleaner and causing the water to enter therein; and d. means for indicating the temperature of the water in the pool or the pressure of the water entering the automatic swimming pool cleaner, the indicating means changing color to provide water-temperature or -pressure information.

24. A system according to claim 23 in which the temperature or pressure information-indicating means comprises a hose.

25. A system according to claim 23 in which the temperature or pressure information-indicating means is attached to or incorporated into the automatic swimming pool cleaner.

26. A swimming pool water-circulation system associated with a swimming pool adapted to contain water and defining a perimeter, the system comprising:

a. a pump;

b. piping connecting the pump to the swimming pool; and c. means, comprising a hose contained at least partially within the perimeter, for indicating information concerning the temperature of any water contained within the swimming pool.

27. A swimming pool water-circulation system associated with a swimming pool adapted to contain water and defining a perimeter, the system comprising:

a. a pump;

b. piping connecting the pump to the swimming pool; and c. means contained at least partially within the perimeter for indicating information concerning the temperature of any water contained within the swimming pool, the temperature information-indicating means changing color to provide the water-temperature information.

28. An automatic swimming pool cleaner for use in a swimming pool, comprising:

a. a body (i) automatically displaceable laterally within the swimming pool and (ii) through which water contained in the swimming pool may flow; and b. a float at least partly contained within the body but visible outside the body.

* * * * *